US007618167B2

(12) United States Patent
Bédard

(10) Patent No.: US 7,618,167 B2
(45) Date of Patent: Nov. 17, 2009

(54) RECESSED LIGHT FIXTURE

(76) Inventor: Sylvain Bédard, 5100, Armand-Frappier, St-Hubert, Quebec (CA) J3Z 1G6

( * ) Notice: Subject to any disclaimer, the term of this patent is extended or adjusted under 35 U.S.C. 154(b) by 127 days.

(21) Appl. No.: 11/902,005

(22) Filed: Sep. 18, 2007

(65) Prior Publication Data

US 2008/0068847 A1 Mar. 20, 2008

(30) Foreign Application Priority Data

Sep. 18, 2006 (GB) ..... 0618295.0

(51) Int. Cl.
*F21V 15/00* (2006.01)

(52) U.S. Cl. ..... 362/366; 362/364

(58) Field of Classification Search ..... 362/364, 362/365, 366

See application file for complete search history.

(56) References Cited

U.S. PATENT DOCUMENTS 5,377,088 A * 12/1994 Lecluze ..... 362/366
2007/0217207 A1* 9/2007 Caluori ..... 362/365
2009/0010007 A1* 1/2009 Caluori ..... 362/366

* cited by examiner

*Primary Examiner*—David V Bruce

(57) ABSTRACT

A recessed light fixture mountable to a panel. The panel defines a panel aperture extending therethrough. The recessed light fixture includes a housing, the housing defining an end wall and a side wall extending from the end wall. The side wall defines a side wall edge substantially opposed to the end wall. The housing further defines a housing flange extending substantially peripherally and outwardly from the side wall substantially adjacent the side wall edge. A retaining clip is mounted to the housing. The retaining clip includes a clip mounting element mounted to the housing. A clip body is also included in the retaining clip and defines a retaining flange. The retaining flange is located outside of the housing in a substantially parallel and spaced apart relationship relatively to the housing flange when the retaining clip is mounted to the housing in an operative configuration. An actuator is operatively coupled to the clip mounting element and to the clip body for moving the clip body and the clip mounting element relatively to each other so as to vary a retaining flange-to-housing flange distance between the retaining flange and the housing flange; When the housing is mounted through the panel aperture with the panel positioned between the housing and retaining flanges, using the actuator to move the clip body relatively to the clip mounting element moves the retaining flange relatively to the housing flange to allow the attachment of the light fixture to the panel by pinching the panel between the housing flange and the retaining flange.

13 Claims, 2 Drawing Sheets

RECESSED LIGHT FIXTURE

This application claims priority from UK Request for the Grant of a Patent Serial Number 0618295.0 filed Sep. 18, 2006.

FIELD OF THE INVENTION

The present invention relates to the general field of lighting products and is more particularly concerned with a recessed light fixture.

BACKGROUND OF THE INVENTION

Recessed lighting fixtures used in residential and commercial premises are known in the art and are generally represented by industry standard lighting fixtures that are adapted to be mounted in a cut-out opening in a drywall or a suspended ceiling. These lighting fixtures are generally equipped with attachment means that allow their installation in supporting drywalls or suspended ceiling without relying on any supporting structure, or requiring any access, behind the supporting surface, since it is generally inaccessible.

The prior art proposes numerous recessed lighting fixtures, each having its own design of attachment means for fastening the later inside a cut-out opening in a ceiling or wall. Some of the designs are based on spring clips that are inserted through peripheral slots from within the fixture housing once the latter is inserted in the supporting surface. While this solution can be very simple and economical to produce, the spring clips do not apply an equal or adjusted pressure for various thicknesses of supporting surfaces. Another typical approach includes pivotable clips that are deployed from within the fixture housing and over the adjacent rear surface of the ceiling or wall. This solution usually applies to only one standard thickness of supporting surfaces. Yet another common approach includes pivoting or spring clips that are closely affixed to the outer peripheral side wall or walls of the fixture housing, and which are deployed or compressed against the rear of the supporting surface once the fixture is inserted in the later. These approaches generally require additional incisions, cuttings or piercing in the peripheral edge of the main cut-out opening, to make room for these external clips when the fixture housing is inserted therein.

Accordingly, there exists a need for an improved recessed light fixture. It is a general object of the present invention to provide such a recessed light fixture.

SUMMARY OF THE INVENTION

In a broad aspect, the invention provides a recessed light fixture mountable to a panel. The panel defines a panel aperture extending therethrough. The recessed light fixture includes a housing, the housing defining an end wall and a side wall extending from the end wall. The side wall defines a side wall edge substantially opposed to the end wall. The housing further defines a housing flange extending substantially peripherally and outwardly from the side wall substantially adjacent the side wall edge. A retaining clip is mounted to the housing. The retaining clip includes a clip mounting element mounted to the housing. A clip body is also included in the retaining clip and defines a retaining flange. The retaining flange is located outside of the housing in a substantially parallel and spaced apart relationship relatively to the housing flange when the retaining clip is mounted to the housing in an operative configuration. An actuator is operatively coupled to the clip mounting element and to the clip body for moving the clip body and the clip mounting element relatively to each other so as to vary a retaining flange-to-housing flange distance between the retaining flange and the housing flange. When the housing is mounted through the panel aperture with the panel positioned between the housing and retaining flanges, using the actuator to move the clip body relatively to the clip mounting element moves the retaining flange relatively to the housing flange to allow the attachment of the light fixture to the panel by pinching the panel between the housing flange and the retaining flange.

Advantageously, the proposed light fixture is relatively easily manufacturable using known materials and methods. Furthermore, the proposed light fixture is operable by an intended user using a relatively small number of relatively quick and ergonomic steps. Yet furthermore, positioning of the recessed light fixture and attachment of the recessed light fixture to the panel typically does not require the use of specialized tools.

In some embodiments of the invention, the retaining clip is removably mountable to the housing from inside of the housing. In these embodiments, the recessed light fixture is insertable through the panel aperture without either requiring that relatively complex manipulations of the recessed light fixture be performed, or that the access aperture be given a shape including indentations for allowing protruding structure of the retaining clip to be inserted through the panel aperture. Furthermore, by being operated from within the housing, the retaining clip is relatively easily moved relatively to the housing to allow attaching the recessed light fixture to the panel.

In some embodiments of the invention, the actuator includes a threaded fastener, such as, for example, a screw, that moves the clip body and the clip mounting element relatively to each other when screwed or unscrewed. The use of a screw in the actuator allows to use a conventional screwdriver to move the clip mounting element and the clip body relatively to each other, thereby facilitating the use of the recessed light fixture.

Other objects, advantages and features of the present invention will become more apparent upon reading of the following non-restrictive description of preferred embodiments thereof, given by way of example only with reference to the accompanying drawings.

BRIEF DESCRIPTION OF THE DRAWINGS

An embodiment of the present invention will now be disclosed, by way of example, in reference to the following drawings, in which.

DETAILED DESCRIPTION

Figure 1:
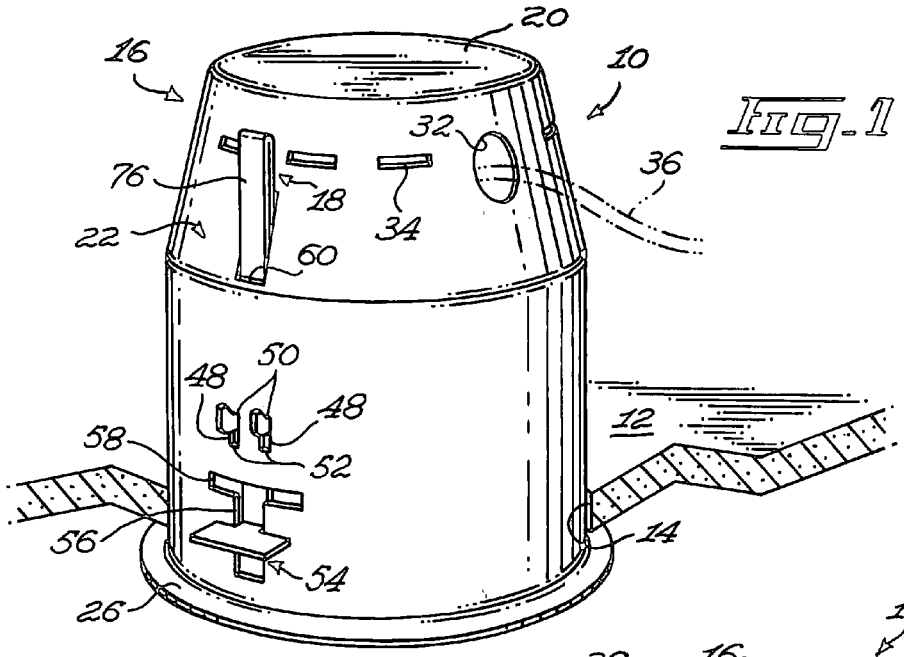
FIG. 1, in a perspective view, illustrates a recessed light fixture in accordance with an embodiment of the present invention, the recessed light fixture being shown mounted to a panel, the panel being shown with a portion thereof removed.

Referring to FIG. 1, there is shown a recessed light fixture 10 mountable to a panel 12. The panel 12 defines a panel aperture 14 extending therethrough. The recessed light fixture 10 includes a housing 16 and a retaining clip 18 mounted to the housing 16. The recessed light fixture 10 is usable for mounting thereinto a light bulb and a socket for receiving the light bulb (both not shown in the drawings).

Figure 2:
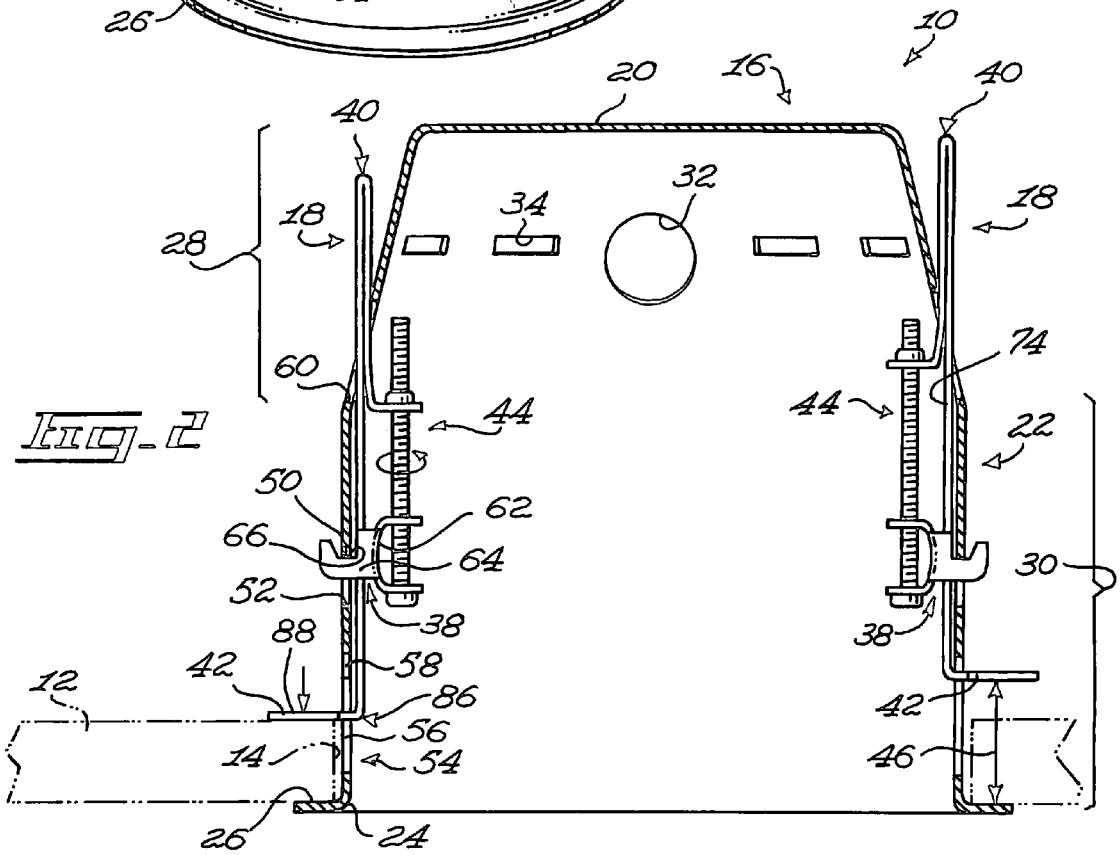
FIG. 2, in a side cross-sectional view, illustrates the recessed light fixture shown in FIG. 1.

As seen in FIG. 2, in some embodiments of the invention, the proposed recessed light fixture 10 includes two retaining clips 18. However, it is within the scope of the invention to include any suitable number of retaining clips 18.

The panel 12 is typically a side wall, a floor or a ceiling of a building, or a part thereof. However, it is within the scope of the invention to attach the proposed recessed light fixture 10 to any other suitable panels 12.

Referring to FIG. 2, the housing 16 defines an end wall 20 and a side wall 22 extending from the end wall 20. The side wall 22 defines a side wall edge 24 substantially opposed to the end wall 20. The housing 16 further defines a housing flange 26 extending substantially peripherally and outwardly from the side wall 22 substantially adjacent the side wall edge 24. In some embodiments of the invention, the side wall 22 defines a side wall proximal section 28 extending from the end wall 20 and a side wall distal section 30 extending from the side wall proximal section 28. For example, the side wall proximal section 28 is tapered in a direction leading towards the end wall 20. However, in alternative embodiments of the invention, the side wall proximal section 28 has any other suitable configuration. Furthermore, in some embodiments of the invention, the side wall distal section 30 has a substantially cylindrical configuration and the side wall proximal section 28 has a substantially frusto-conical configuration.

The retaining clip 18 includes a clip mounting element 38 mounted to the housing 16. Also, the retaining clip 18 includes a clip body 40. The clip body 40 defines a retaining flange 42. The retaining flange 42 is located outside of the housing 16 in a substantially parallel and spaced apart relationship relatively to the housing flange 26 when the retaining clip 18 is mounted to the housing 16 in an operative configuration as seen, for example, in FIG. 2.

An actuator 44 is operatively coupled to the clip mounting element 38 and to the clip body 40 for moving the clip body 40 and the clip mounting element 38 relatively to each other so as to vary a retaining flange-to-housing flange distance 46 between the retaining flange 42 and the housing flange 26.

When the housing 16 is mounted through the panel aperture 14 with the panel 12 positioned between the housing and retaining flanges 26 and 42, using the actuator 44 to move the clip body 40 relatively to the housing flange 26 allows the attachment of the recessed light fixture 10 to the panel 12 by pinching the panel 12 between the housing flange 26 and the retaining flange 42.

Typically, the retaining clip 18 is removably mountable to the housing 16. This is achievable, for example, by having a housing 16 configured and sized for receiving the retaining clip 18 so that the clip mounting element 38 is removably mounted to the housing 16.

In some embodiments of the invention, as seen in FIG. 2, the retaining flange 42 protrudes outwardly from the housing 16 and the remainder of the retaining clip 18 is entirely located in a radially inward location relatively to the housing flange 26. Therefore, the retaining clip 18 is readily accessible from within the housing 16, which facilitates the installation of the recessed light fixture 10 to the panel 12.

Referring to FIG. 1, the housing 16 typically defines a wiring aperture 32 and one or more venting apertures 34. The wiring aperture 32 is provided for allowing the insertion therethrough of wiring 36 usable to provide electrical power to the light bulb (not shown in the drawings) to be received within the recessed light fixture 10. The venting apertures 34 are provided for facilitating the evacuation of heat generated by the light bulb (not shown in the drawings). Typically, the wiring aperture 32 and the venting apertures 34 are located substantially adjacent the end wall 20, for example in the side wall proximal section 28. In embodiments of the invention in which the side wall proximal section 28 is tapered towards the end wall 20, for example by having a substantially frusto-conical configuration, providing the venting apertures 34 in the side wall proximal section 28 facilitates evacuation of heat through convection of hot air that rises through the venting apertures 34.

In a specific embodiment of the invention, the side wall 22 defines a pair of mounting slots 48. The mounting slots 48 each extend through the side wall 22, for example in the side wall distal section 30. The mounting slots 48 are substantially longitudinally oriented and substantially circumferentially spaced apart from each other. Each of the mounting slots 48 defines a respective slot proximal peripheral edge 50 and a substantially opposed slot distal peripheral edge 52. The slot proximal peripheral edges 50 are each located closer to the end wall 20 than their opposed slot distal peripheral edges 52.

The side wall 22 defines a retaining flange receiving aperture 54. Typically, the retaining flange receiving aperture 54 has a substantially T-shaped configuration and includes a guiding segment 56 extending substantially longitudinally and an insertion segment 58 intersecting the guiding segment 56 and extending substantially circumferentially. For example, the guiding segment 56 extends substantially longitudinally away from the insertion segment 58 and substantially longitudinally away from the end wall 20. The guiding segment 56 is typically substantially co-linear and substantially parallel to the two mounting slots 48. The retaining flange receiving aperture 54 is also typically located further away from the end wall 20 than the mounting slots 48.

The housing 16 further defines a stabilization aperture 60. The stabilization aperture 60 is typically formed in the side wall proximal section 28 and extends substantially perpendicularly to the end wall 20.

Figure 4:
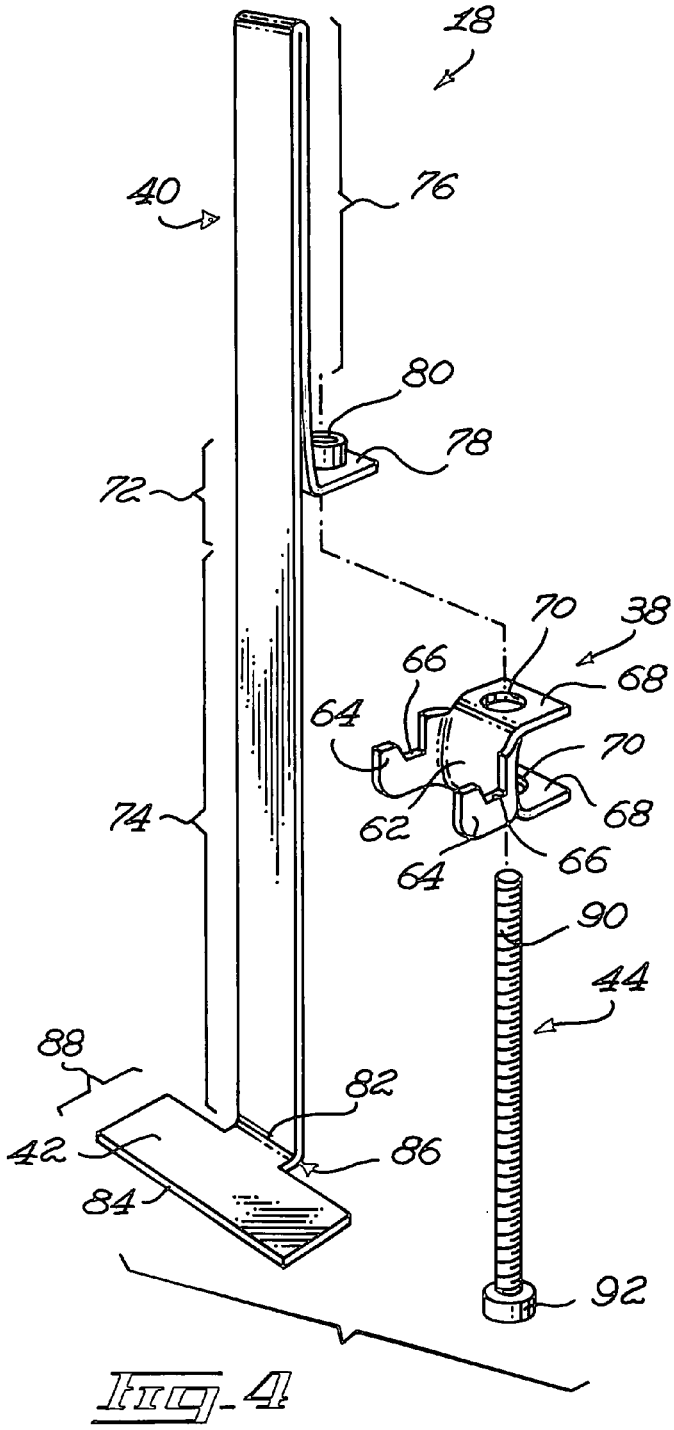
FIG. 4, in a perspective exploded view, illustrates the retaining clip of the recessed light fixture shown in FIGS. 1 to 3.

Referring to FIG. 4, the clip mounting element 38 includes a mounting element base 62 and a mounting flange 64 extending from the mounting element base 62. For example, the mounting element base 62 is substantially plate-shaped.

Typically, the clip mounting element 38 includes two mounting flanges 64, each extending from the mounting element base 62. The mounting flanges 64 are in a substantially parallel and spaced apart relationship relatively to each other. In a specific embodiment of the invention, the mounting flanges 64 are each substantially hook-shaped and each defines a hook recess 66. The mounting element base 62 is located within the housing 16 and the mounting flanges 64 each extend through a respective one of the mounting slots 48 when the retaining clip 18 is mounted to the housing 16 in the operative configuration, as seen in FIG. 2. The mounting flanges 64 are removably insertable into a respective one of the mounting slots 48. In embodiments in which the mounting flanges 64 are hook-shaped, the hook recess 66 of each of the mounting flanges 64 engages the slot proximal peripheral edge 50 when the retaining clip 18 is mounted to the housing 16 in the operative configuration.

Returning to FIG. 4, the clip mounting element 38 includes at least one mounting element actuator mounting flange 68 and, typically, a pair of mounting element actuator mounting flanges 68 which are substantially parallel to each other and substantially spaced apart from each other. The mounting element actuator mounting flanges 68 extend from the mounting element base 62 and, typically, are each substantially perpendicular to the mounting flanges 64. Each of the mounting element actuator mounting flange 68 defines a respective mounting element flange aperture 70 extending therethrough, the mounting element flange apertures 70 being substantially in register with each other.

The clip body 40 defines an actuator coupling section 72 for coupling the actuator 44 to the clip body 40. The clip body 40 also defines a spacing section 74 extending between the retaining flange 42 and the actuator coupling section 72. In some embodiments of the invention, the clip body 40 also defines a stabilizing section 76 extending from the actuator coupling section 72 substantially away from the spacing section 74.

For example, the clip body 40 is manufactured by taking a substantially elongated piece of sheet metal, folding the piece of sheet metal over itself at a location intermediate its ends and folding the two opposed end sections of the piece of sheet metal to form the retaining flange 42 and a body actuator mounting flange 78 extending substantially perpendicularly to the spacing section 74 in the actuator coupling section 72, and substantially parallel to the retaining flange 42. The body actuator mounting flange 78 defines a body flange aperture 80 extending therethrough.

As seen in FIG. 1, the stabilizing section 76 is typically substantially elongated and extends through the stabilization aperture 60 when the retaining clip 18 is in the operative configuration. In this configuration, the stabilizing section 76 is typically substantially perpendicular to the end wall 20 and guides the clip body 40 so that the clip body 40 is movable relatively to the housing 16 in a direction substantially perpendicular to the end wall 20.

Returning to FIG. 4, the retaining flange 42 defines a retaining flange proximal end 82 located substantially adjacent the spacing section 74 and a retaining flange distal end 84 located substantially opposed to the retaining flange proximal end 82. The retaining flange 42 extends over a larger distance circumferentially substantially adjacent the retaining flange distal end 84 than substantially adjacent the retaining flange proximal end 82. For example, the retaining flange 42 has a substantially T-shaped configuration and is substantially parallel to the end wall 20. The retaining flange 42 defines a panel abutment portion 88 and a linking portion 86. The panel abutment portion 88 is spaced apart from the spacing section 74 by the linking portion 86, which extends therefrom. The panel abutment portion 88 is provided for abutting against the panel 12.

Typically, the retaining flange 42 protrudes outwardly from the side wall 22 further away than the housing flange 26. This allows spreading of the forces exerted by the housing 16 onto the panel 12 due to the weight of the recessed light fixture 10 over a relatively large surface so as to reduce the risks of damaging the panel 12.

As seen in FIG. 2, typically, the spacing section 74 is located inside of the housing 16 and the retaining flange 42 extends through the retaining flange receiving aperture 54 so as to protrude outwardly from the housing 16 when the retaining clip 18 is in the operative configuration. The retaining flange 42 is removable from the housing 16 only when substantially in register with the insertion segment 58, which is dimensioned to allow the retaining flange 42 to be inserted thereinto and removed therefrom. The guiding segment 56 is dimensioned such that only the linking portion 86 can extend therethrough, thereby preventing the retaining flange 42 from being removed from the housing 16 when the retaining flange 42 is substantially adjacent the guiding segment 56. Also, the guiding segment 56 guides the retaining flange as it moves relatively to the housing flange 26 upon actuation of the actuator 44.

In other words, the panel abutment portion 88 extends substantially circumferentially over a smaller distance than the insertion segment 58 and over a larger distance than the guiding segment 56 and the insertion segment 58 extends substantially longitudinally over a larger distance than the panel abutment portion 88.

Referring to FIG. 4, the actuator 44 includes a threaded fastener operatively coupled to the clip mounting element 38 and to the clip body 40 so as to move the retaining flange 42 relatively to clip mounting element 38 upon being screwed and unscrewed relatively to the clip mounting element 38. For example, the threaded fastener takes the form of a screw including a substantially cylindrical threaded shaft 90 and a screw head 92 extending substantially radially outwardly therefrom.

The actuator 44 is typically mounted to the clip mounting element 38 and to the clip body 40 by being screwable to at least one of the mounting element and body actuator mounting flanges 68 and 78 and being operatively coupled to the other one of the mounting element and body actuator mounting flanges 68 and 78 so as to move the retaining flange 42 relatively to the clip mounting element 38 upon being screwed relatively to the at least one of the mounting element and body actuator mounting flanges 68 and 78 when the retaining clip 18 is in the operative configuration.

For example, the body and mounting element actuator mounting flanges 78 and 68 are in a substantially parallel and spaced apart relationship relatively to each other when the retaining clip is in the operative configuration. The threaded shaft 90 extends through the mounting element flange apertures 70 and is screwed to the body actuator mounting flange 78, for example by engaging the peripheral edge of the body flange aperture 80. In these embodiments, abutting the screw head 92 against one of the mounting element actuator mounting flange 68 and screwing or unscrewing the actuator 44 moves the clip mounting element 38 relatively to the clip body 40.

Figure 3:
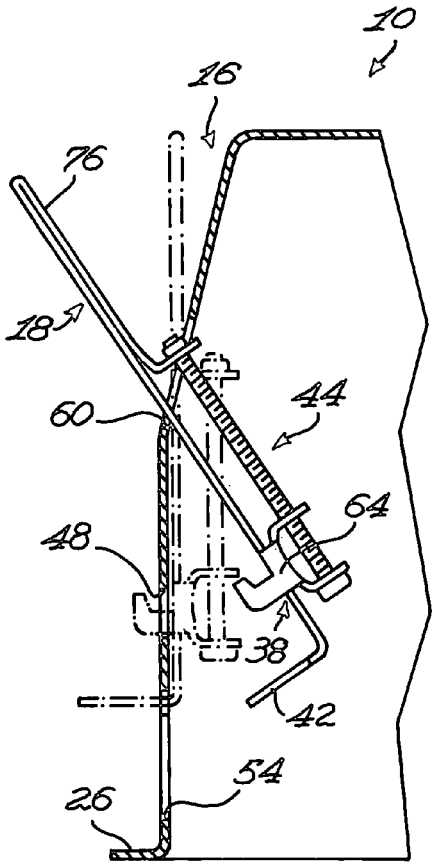
FIG. 3, in a side cross-sectional view with portions removed, illustrates the attachment of a retaining clip of the recessed light fixture shown in FIGS. 1 and 2 to a housing of the recessed light fixture.

In use, the housing 16 is first provided separated from the retaining clip 18. Then, the housing 16 is inserted through the panel aperture 14 until the housing flange 26 abuts against the panel 12. Afterwards, the stabilizing section 76 is inserted through the stabilization aperture 60 with the retaining clip 18 angled relatively to the vertical, as seen in FIG. 3, and the retaining clip 18 is pivoted so that the mounting flanges 64 are inserted through the mounting slots 48, as illustrated in phantom lines in FIG. 3.

Afterwards, the actuator 44 is screwed so that the clip mounting element 38 moves away from the retaining flange 42. As the hook recesses 66 abut against the slot proximal peripheral edges 50, the clip mounting element 38 stops from moving relatively to the housing 16 and the retaining flange 42 moves towards the housing flange 26, as seen in FIG. 2. When the retaining flange 42 abuts against the panel 12, screwing the actuator 44 allows to exert a suitable compressive force onto the panel 12 so that the housing 16 is fixed relatively to the panel aperture 14. Removal of the proposed recessed light fixture 10 from the panel 12 may be performed by reversing this sequence of operation.

Although the present invention has been described hereinabove by way of preferred embodiments thereof, it can be modified, without departing from the spirit and nature of the subject invention as defined in the appended claims.

What is claimed is:

1. A recessed light fixture mountable to a panel, said panel defining a panel aperture extending therethrough, said recessed light fixture comprising:

a housing, said housing defining an end wall and a side wall extending from said end wall, said side wall defining a side wall edge substantially opposed to said end wall, said housing further defining a housing flange extending substantially peripherally and outwardly from said side wall substantially adjacent said side wall edge, said side wall also defining a pair of mounting slots, said mounting slots each extending through said side wall and being substantially longitudinally oriented, said mounting slots being substantially circumferentially spaced apart from each other; and a retaining clip removably mountable to said housing, said retaining clip including a clip mounting element mounted to said housing;

a clip body, said clip body defining a retaining flange, said retaining flange being located outside of said housing in a substantially parallel and spaced apart relationship relatively to said housing flange when said retaining clip is mounted to said housing in an operative oonfiguration; and an actuator operatively coupled to said clip mounting element and to said clip body for moving said clip body and said clip mounting element relatively to each other so as to vary a retaining flange-to-housing flange distance between said retaining flange and said housing flange;

said clip mounting element including a mounting element base and a pair of mounting flanges extending from said mounting element base, said mounting flanges being in a substantially parallel and spaced apart relationship relatively to each other, said mounting element base being located within said housing and said mounting flanges each extending through a respective one of said mounting slots when said retaining clip is mounted to said housing in said operative configuration, said mounting flanges each being removably insertable into said respective one of said mounting slots;

whereby, when said retaining clip is mounted to said housing in said operative configuration and said housing is mounted through said panel aperture with said panel positioned between said housing and retaining flanges, using said actuator to move said clip body relatively to said clip mounting element moves said retaining flange relatively to said housing flange to allow the attachment of said recessed light fixture to said panel by pinching said panel between said housing flange and said retaining flange.

2. A recessed light fixture as defined in claim 1, wherein said mounting slot defines a slot proximal peripheral edge and a substantially opposed slot distal peripheral edge, said slot proximal peripheral edge being located closer to said end wall than said slot distal peripheral edge;

said mounting flange defines a hook, said hook defining a hook recess, said hook recess engaging said slot proximal peripheral edge when said retaining clip is mounted to said housing in said operative configuration.

3. A recessed light fixture as defined in claim 1, wherein said actuator includes a threaded fastener operatively coupled to said clip mounting element and to said clip body so as to move said retaining flange relatively to said clip mounting element upon being screwed and unscrewed relatively to said clip mounting element so as to vary said retaining flange-to-housing flange distance.

4. A recessed light fixture as defined in claim 3, wherein said clip body defines a body actuator mounting flange and said clip mounting element defines a mounting element actuator mounting flange, said body and mounting element actuator mounting flanges being in a substantially parallel and spaced apart relationship relatively to each other, said threaded fastener being screwable to at least one of said mounting element and body actuator mounting flanges and being operatively coupled to the other one of said mounting element and body actuator mounting flanges so as to move said retaining flange relatively to said clip mounting element upon being screwed relatively to said at least one of said clip mounting and body actuator mounting element when said retaining clip is in said operative configuration.

5. A recessed light fixture as defined in claim 4, wherein said mounting element actuator mounting flange defines a mounting element flange aperture extending therethrough and said body actuator mounting flange defines a body flange aperture extending therethrough, said threaded fastener extending through said mounting element flange and being screwed to said body flange.

6. A recessed light fixture as defined in claim 1, wherein said clip body defines an actuator coupling section for coupling said actuator to said clip body and a spacing section extending between said retaining flange and said actuator coupling section.

7. A recessed light fixture as defined in claim 6, wherein said side wall defines a retaining flange receiving aperture, said spacing section being located inside of said housing and said retaining flange extending through said retaining flange receiving aperture so as to protrude outwardly from said housing when said retaining clip is in said operative configuration.

8. A recessed light fixture as defined in claim 7, wherein said retaining flange defines a panel abutment portion and a linking portion, said linking portion extending from said spacing section and said panel abutment portion extending from said linking portion so as to be spaced apart from said spacing section, said panel abutment portion extending circumferentially over a larger distance than said linking portion;

said retaining flange receiving aperture defines a guiding segment extending substantially longitudinally and an insertion segment intersecting said guiding segment and extending substantially circumferentially, said panel abutment portion extending substantially circumferentially over a smaller distance than said insertion segment and over a larger distance than said guiding segment, said insertion segment extending substantially longitudinally over a larger distance than said panel abutment portion.

9. A recessed light fixture as defined in claim 8, wherein said guiding segment extends substantially longitudinally away from said insertion segment, said insertion segment being located closer to said end wall than said guiding segment.

10. A recessed light fixture as defined in claim 6, wherein said clip body defines a stabilizing section extending from said actuator coupling section substantially away from said spacing section and said housing defines a stabilization aperture receiving said stabilizing section therethrough when said retaining clip is in said operative configuration.

11. A recessed light fixture as defined in claim 10, wherein said side wall defines a side wall proximal section extending from said end wall and a side wall distal section extending from said side wall proximal section, said side wall proximal section being tapered in a direction leading towards said end wall, said stabilization aperture extending through said side wall proximal section.

12. A recessed light fixture as defined in claim 1, wherein said retaining flange protrudes outwardly from said side wall further away than said housing flange.

13. A recessed light fixture as defined in claim 1, wherein said retaining flange protrudes outwardly from said housing and the remainder of said mounting clip is entirely located in a radially inward location relatively to said housing flange.

* * * * *